US006682645B2

(12) United States Patent
Nishino et al.

(10) Patent No.: US 6,682,645 B2
(45) Date of Patent: Jan. 27, 2004

(54) PROCESS FOR PRODUCING ALUMINUM SUPPORT FOR LITHOGRAPHIC PRINTING PLATE

(75) Inventors: Atsuo Nishino, Shizuoka (JP); Yoshitaka Masuda, Shizuoka (JP); Hirokazu Sawada, Shizuoka (JP); Akio Uesugi, Shizuoka (JP)

(73) Assignee: Fuji Photo Film Co., Ltd., Minami Ashigara (JP)

( * ) Notice: Subject to any disclaimer, the term of this patent is extended or adjusted under 35 U.S.C. 154(b) by 193 days.

(21) Appl. No.: 09/873,186

(22) Filed: Jun. 5, 2001

(65) Prior Publication Data

US 2001/0025799 A1 Oct. 4, 2001

Related U.S. Application Data

(62) Division of application No. 09/212,256, filed on Dec. 16, 1998, now Pat. No. 6,264,821.

(30) Foreign Application Priority Data

Dec. 16, 1997 (JP) ..... 9-346513
Feb. 26, 1998 (JP) ..... 10-45607
Feb. 26, 1998 (JP) ..... 10-45608

(51) Int. Cl.[7] ..... C25F 3/20; C25D 9/00

(52) U.S. Cl. ..... 205/658; 205/659; 205/661; 205/674; 205/324; 205/219; 205/685; 216/103

(58) Field of Search ..... 205/660, 662, 205/674, 681, 685, 658–659, 661, 324, 219; 216/103

(56) References Cited

U.S. PATENT DOCUMENTS

| | | | | |
|---|---|---|---|---|
| 4,272,342 | A | | 6/1981 | Oda et al. |
| 4,561,944 | A | | 12/1985 | Sasaki et al. |
| 4,655,136 | A | | 4/1987 | Reiss et al. |
| 4,824,535 | A | | 4/1989 | Pliefke et al. |
| 4,824,757 | A | | 4/1989 | Aono et al. |
| 4,833,065 | A | | 5/1989 | Nakanishi et al. |
| 4,902,389 | A | * | 2/1990 | Nishino et al. ..... 205/651 |
| 5,082,537 | A | | 1/1992 | Strosynski et al. |
| 5,832,834 | A | * | 11/1998 | Nishino et al. ..... 205/127 X |

FOREIGN PATENT DOCUMENTS

| | | |
|---|---|---|
| EP | 0422682 | 4/1991 |
| EP | 0701908 | 3/1996 |
| EP | 0757122 | 2/1997 |
| GB | 2047274 | 11/1980 |
| JP | 53-67507 | 6/1978 |
| JP | 54-65607 | 5/1979 |
| JP | 56-25381 | 3/1981 |
| JP | 56-29699 | 3/1981 |

* cited by examiner

*Primary Examiner*—Donald R. Valentine
(74) *Attorney, Agent, or Firm*—Burns, Doane, Swecker & Mathis, LLP

(57) ABSTRACT

In a process for producing an aluminum support of a lithographic printing plate, the desired aluminum support is produced by imparting fine asperities to an aluminum plate and then roughening it electrochemically in an acidic aqueous solution. The roughened aluminum plate may be electropolished or chemically etched.

14 Claims, 2 Drawing Sheets

PROCESS FOR PRODUCING ALUMINUM SUPPORT FOR LITHOGRAPHIC PRINTING PLATE

This application is a divisional of application Ser. No. 09/212,256, filed on Dec. 16, 1998, now U.S. Pat. No. 6,264,821.

BACKGROUND OF THE INVENTION

1. Field of the Invention

The present invention relates to a process for producing an aluminum plate for use as the support of a lithographic printing plate. Specifically, the present invention relates to a method of roughening an aluminum plate for use as the support for a lithographic plate. In particular, the present invention relates to a method suitable for roughening an aluminum plate which is prone to the appearance of streaks or grainy unevenness in surface quality due to directional differences in crystal grains, both defects being highly likely to occur in the conventional chemical etching techniques.

2. Description of the Related Art

A method commonly adopted for producing aluminum supports for lithographic printing plates is AC etching which employs either an ordinary sinusoidal wave current or a current of a special alternating waveform such as a rectangular wave. By feeding an alternating current with a suitable counter electrode usually made of graphite, the aluminum plate is subjected to roughening, typically in one cycle. The pits produced by this treatment are generally shallow and do not assure a long press life. Under the circumstances, various methods have been proposed with a view to producing aluminum plates that have a grained surface characterized by a uniform and dense distribution of pits having a relatively great depth compared to diameter and which, hence, are suitable for use as the support of printing plates. Examples include roughening with a current from a special electrolytic power supply (Unexamined Published Japanese Patent Application (kokai) No. 67507/1978), adjusting the ratio between the amount of electricity applied in the anode cycle of AC electrolytic roughening and that in the cathode cycle (Unexamined Published Japanese Patent Application (kokai) No. 65607/1979), using a current of a special waveform from a power supply (Unexamined Published Japanese Patent Application (kokai) No. 25381/1981) and a combination of different quantities of current supply per unit area (U.S. Pat. No. 4,272,342 which corresponds to Unexamined Published Japanese Patent Application (kokai) No. 29699/1981).

Conventionally, aluminum supports are produced by the following process: an aluminum ingot is melted and held at a specified temperature to make a slab (400 to 600 mm thick by 1,000 to 2,000 mm wide by 2,000 to 6,000 mm long); an impurity-containing structure of the slab's surface is cut off in thickness of 3 to 10 mm by means of a facing machine; in order to remove the stress within the slab and homogenize its structure, the slab is heat treated by being held in a soaking furnace at 480 to 540° C. for 6 to 12 h; the slab is subsequently annealed to provide a homogeneous rolled structure and finally cold rolled to a specified thickness so that it is straightened to give a high degree of flatness. The thus produced aluminum web has been used as the support of lithographic printing plates.

Aluminum plates can be produced by a process that eliminates the steps of intermediate annealing and soaking treatments from the conventional process of manufacturing aluminum plates. Using such aluminum plates or general-purpose aluminum plates as the support for lithographic printing plates is desirable from the viewpoints of saving energy and effective utilization of resources.

In fact, however, "streaks" and grainy unevenness in surface quality have often appeared when the support lithographic printing plates are manufactured from the above-mentioned aluminum plates. This is usually explained as follows: in the progress of a chemical dissolving reaction in aluminum, the rate of dissolution varies with crystal direction, so the electrochemical pitting reaction of aluminum will proceed at varying rates with the crystal direction.

In short, the asperities produced by the difference in the rate of chemical dissolving reaction are visually seen as streaks or grainy unevenness in surface quality or, alternatively, the difference in pitting reaction depending on the crystal direction (e.g. the difference in the number or size of pits) is seen as streaks or grainy unevenness in surface quality.

SUMMARY OF THE INVENTION

The present invention provide a process for producing an aluminum plate for use as the support for lithographic printing plates that are free from defects called "streaks" or "grainy unevenness in surface quality".

The present invention provides a process for producing an aluminum support for lithographic printing plates that comprises preliminarily imparting fine asperities to an aluminum plate and thereafter roughening the plate electrochemically in an acidic aqueous solution.

The fine asperities imparted to an aluminum plate cause random reflection that makes streaks or grainy unevenness in surface quality difficult to be seen. The fine asperities also offer the advantage that honeycomb pits having an average diameter of 0.1 to 3 $\mu$m can be generated uniformly irrespective or crystal direction in an aqueous solution of nitric acid to be subsequently formed.

The present invention provides a process for producing an aluminum support for lithographic printing plates that comprises in sequence the steps of:

(1) subjecting an aluminum plate to preliminary AC electrochemical roughening in an aqueous solution based on hydrochloric acid using electricity in an amount of 1 to 300 C/dm$^2$;

(2) immersing the aluminum plate in an aqueous solution of an acid or an alkali to perform chemical etching or electropolishing with the aluminum plate being used as anode, so that the aluminum plate is dissolved in an amount of 0.01 to 1.5 g/m$^2$;

(3) subjecting the aluminum plate to DC or AC electrochemical roughening in an aqueous solution based on nitric acid; and (4) immersing the aluminum plate in an aqueous solution of an acid or an alkali to perform chemical etching or electropolishing with the aluminum plate being used as anode, so that the aluminum plate is dissolved in an amount of 0.01 to 10 g/m$^2$.

In the present invention, the fine asperities imparted to an aluminum plate cause random reflection that makes streaks or grainy unevenness in surface quality difficult to be seen. The fine asperities also offer the advantage that honeycomb pits having an average diameter of 0.1 to 3 $\mu$m can be generated uniformly irrespective or crystal direction in an aqueous solution of nitric acid to be subsequently formed.

Another advantage that can be obtained is that uniform honeycomb pits can be formed even in aluminum plates that contain fairly large amounts of trace elements and with which uniform electrochemical roughening is difficult to achieve in aqueous nitric acid.

The fine asperities imparted to an aluminum plate cause random reflection that makes streaks or grainy unevenness in surface quality difficult to be seen. The fine asperities also offer the advantage that honeycomb pits having an average diameter of 0, 1 to 3 $\mu$m can be generated uniformly irrespective of crystal direction in an aqueous solution of nitric acid to be subsequently formed.

Thus, the present invention relates basically to a process for producing an aluminum support for producing lithographic printing plates that comprises in sequence the steps of:

(1) subjecting the aluminum plate to AC electrochemical roughening in an aqueous solution based on nitric acid at a temperature of 60 to 95° C. so as to form honeycomb pits with an average diameter of 0.1 to 0.5 $\mu$m using electricity in an amount of 1 to 150 C/dm$^2$; and (2) immersing the aluminum plate in an aqueous solution of an acid or an alkali to perform chemical etching or electropolishing with the aluminum plate being used as anode, so that the aluminum plate is dissolved in an amount of 0.01 to 10 g/m$^2$.

DETAILED DESCRIPTION OF THE DRAWINGS

Figure 1:
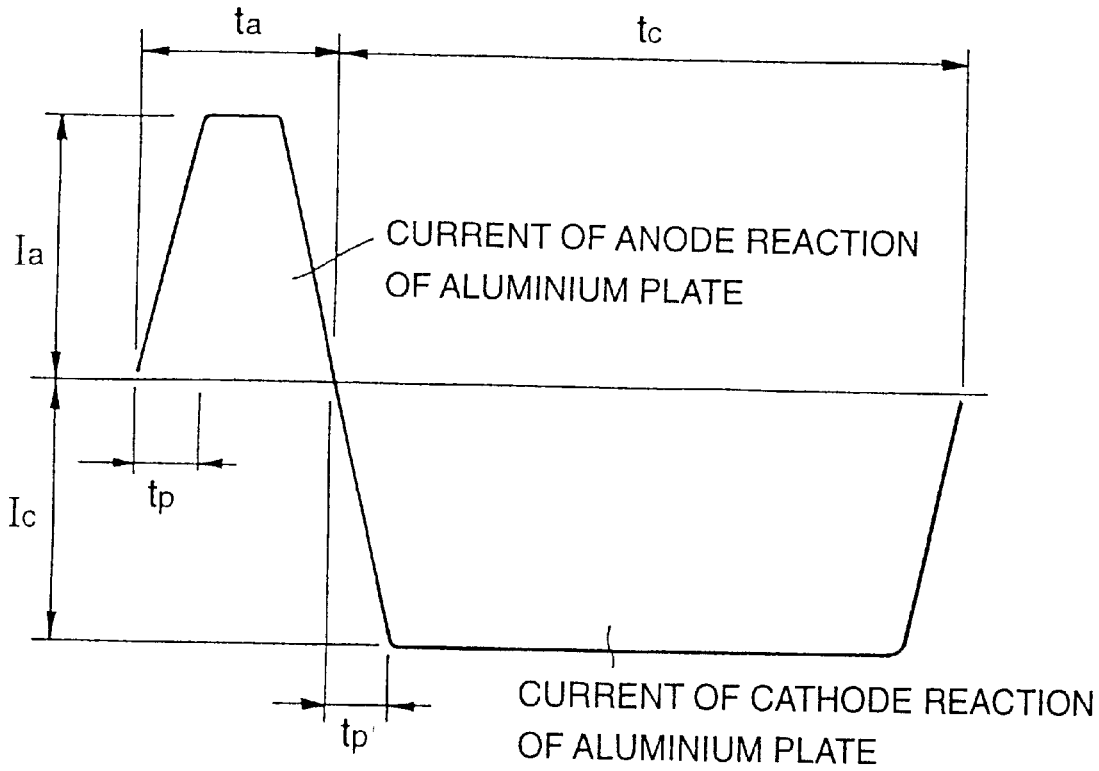
FIG. 1 is a diagram showing an exemplary trapezoidal waveform from an AC power supply that is preferably employed in the step of electrochemical roughening in the process of the present invention.

Detailed description of the present invention will be described as follows referring to the accompanying drawings.

Embodiments of the Invention

Several embodiments of the roughening method of the present invention are hereunder described in detail.

Embodiment 1

In a process for producing an aluminum support for a lithographic printing plate, an aluminum plate is subjected to, in sequence, the steps of:

(1) preliminarily forming fine asperities; and (2) roughening the aluminum plate electrochemically in an acidic aqueous solution.

Embodiment 2

In a process for producing an aluminum support for a lithographic printing plate, an aluminum plate is subjected to, in sequence, the steps of:

(1) preliminarily forming fine asperities;

(2) roughening the aluminum plate electrochemically in an acidic aqueous solution; and (3) electropolishing the aluminum plate in an aqueous solution of an acid or an alkali, with the aluminum plate being used as anode, or chemically etching the aluminum plate in an aqueous solution of an acid or an alkali, so that the aluminum plate is dissolved in an amount of 0.01 to 6 g/m$^2$.

Embodiment 3

In a process for producing an aluminum support for a lithographic printing plate, an aluminum plate is subjected to, in sequence, the steps of:

(1) roughening the aluminum plate mechanically;

(2) chemically etching the aluminum plate in an aqueous solution of an acid or an alkali, or electropolishing the aluminum plate in an aqueous solution of an acid or an alkali, with the aluminum plate being used as anode, so that the aluminum plate is dissolved in an amount of 1 to 20 g/m$^2$.

(3) preliminarily forming fine asperities;

(4) roughening the aluminum plate electrochemically in an acidic aqueous solution; and (5) electropolishing the aluminum plate in an aqueous solution of an acid or an alkali, with the aluminum plate being used as anode, or chemically etching the aluminum plate in an aqueous solution of an acid or an alkali, so that the aluminum plate is dissolved in an amount of 0.01 to 6 g/m$^2$.

Embodiment 4

A process for producing an aluminum support for lithographic printing plates includes in sequence the steps of:

(1) subjecting an aluminum plate to preliminary AC electrochemical roughening in an aqueous solution based on hydrochloric acid using electricity in an amount of 1 to 300 C/dm$^2$;

(2) immersing the aluminum plate in an aqueous solution of an acid or an alkali to perform chemical etching or electropolishing with the aluminum plate being used as anode, so that the aluminum plate is dissolved in an amount of 0.01 to 1.5 g/m$^2$;

(3) subjecting the aluminum plate to DC or AC electrochemical roughening in an aqueous solution based on nitric acid; and (4) immersing the aluminum plate in an aqueous solution of an acid or an alkali to perform chemical etching or electropolishing with the aluminum plate being used as anode, so that the aluminum plate is dissolved in an amount of 0.01 to 10 g/m$^2$.

Embodiment 5

The process for producing an aluminum plate for lithographic printing plates according to embodiment 4, wherein prior to performing preliminary electrochemical roughening in an aqueous solution of hydrochloric acid, the aluminum plate is subjected, in sequence, to the steps of:

(1) mechanical roughening or DC or AC electrochemical roughening in an aqueous solution based on nitric acid; and (2) chemical etching or electropolishing, with the aluminum plate used as anode, in an aqueous solution of an acid or an alkali so that the aluminum plate is dissolved in an amount of 0.01 to 20 g/m$^2$.

It should be noted that the amount of dissolution of aluminum by the chemical etching in an aqueous solution of an acid or an alkali which is performed after the DC or AC electrochemical roughening in an aqueous solution based on nitric acid is preferably 0.01 to 1.5 g/m$^2$.

The aluminum plate is preferably desmutted in an acidic aqueous solution after it is chemically etched, or electropolished with the aluminum plate used as anode, in an aqueous solution of an acid or an alkali.

It is also preferred that the roughening step is followed by anodizing in order to enhance the wear resistance of the surface of the aluminum plate.

More preferably, the anodized aluminum surface may be hydrophilized as required.

After the graining and anodizing steps, the pores in the aluminum plate are preferably sealed.

Embodiment 6

In a process for producing an aluminum support for a lithographic printing plate, an aluminum plate is subjected to, in sequence, the steps of:

(1) an electrochemical roughening in an aqueous solution based on nitric acid at a temperature of 60 to 95° C. so as to form honeycomb pits with an average diameter of 0.1 to 0.5 $\mu$m using electricity in an amount of 1 to 150 C/dm$^2$; and (2) chemical etching or electropolishing, with the aluminum plate being used as anode, in an aqueous solution of an acid or an alkali so that the aluminum plate is dissolved in an amount of 0.01 to 10 g/m$^2$.

Embodiment 7

In a process for producing an aluminum support for a lithographic printing plate, an aluminum plate is subjected to, in sequence, the steps of:

(1) preliminary AC electrochemical roughening in an aqueous solution based on hydrochloric acid using electricity in an amount of 1 to 300 C/dm$^2$;

(2) chemical etching or electropolishing, with the aluminum plate being used as anode, in an aqueous solution of an acid or an alkali so that the aluminum plate is dissolved in an amount of 0.01 to 1.5 g/m$^2$;

(3) AC electrochemical roughening in an aqueous solution based on nitric acid at a temperature of 60 to 95° C. so as to form honeycomb pits with an average diameter of 0.1 to 0.5 $\mu$m using electricity in an amount of 1 to 150 C/dm$^2$; and (4) chemical etching or electropolishing, with the aluminum plate being used as anode, in an aqueous solution of an acid or an alkali so that the aluminum plate is dissolved in an amount of 0.01 to 10 g/m$^2$.

Embodiment 8

In a process for producing an aluminum support for a lithographic printing plate, prior to preliminary AC electrochemical roughening in an aqueous solution of hydrochloric acid, an aluminum plate is subjected to, in sequence, the steps of:

(1) mechanical roughening or DC or AC electrochemical roughening in an aqueous solution based on nitric acid; and (2) chemical etching or electropolishing, with the aluminum plate used as anode, in an aqueous solution of an acid or an alkali so that the aluminum plate is dissolved in an amount of 0.01 to 20 g/m$^2$.

In the present invention, the method of preliminarily forming fine asperities is preferably by mechanically forming fine asperities on the aluminum plate or by forming fine asperities through chemical etching or by forming fine asperities through electrochemical roughening of the aluminum surface.

Preferably, the method of forming fine asperities is by electrochemical roughening in an aqueous solution of nitric acid or hydrochloric acid.

It is also preferred that the preliminary formation of fine asperities is followed by chemical etching in an aqueous solution of an acid or an alkali or electropolishing in an aqueous solution of an acid or an alkali, with the aluminum plate being used as anode.

Prior to or after or both before and after the electropolishing of the aluminum plate in an aqueous solution of an acid or an alkali, with the aluminum plate being used as anode, the aluminum plate is preferably subjected to chemical dissolution of 0.01 to 3 g/m$^2$, more preferably 0.1 to 1 g/m$^2$.

In a particularly preferred embodiment of the present invention, the amount of dissolution of the aluminum plate by the chemical etching in an aqueous solution of an acid or an alkali which is performed after honeycomb pits with an average diameter of 0.1 to 0.5 $\mu$m are formed using electricity in an amount of 1 to 150 C/dm$^2$ by AC electrochemical roughening in an aqueous solution based on nitric acid at a temperature of 60 to 95° C. is 0.01 to 1.5 g/m$^2$.

After the aluminum plate is chemically dissolved in an aqueous solution of an alkali or electropolished in an aqueous solution of an alkali, with-the aluminum plate being used as anode, the aluminum plate is preferably desmutted in an acidic aqueous solution.

After the roughening step, the aluminum plate is subjected to anodization in order to enhance the wear resistance of its surface.

It is also preferred that after the anodization, the aluminum surface may optionally be hydrophilized.

After the graining and anodizing steps, the pores in the aluminum plate are preferably sealed.

The aluminum plate to be used in the present invention is selected from among a pure aluminum plate, an alloy plate that is based on aluminum and that contains trace amounts of dissimilar elements, and a plastic film laminated or evaporated with aluminum. Dissimilar elements to be contained in the aluminum alloy include silicon, iron, nickel, manganese, copper, magnesium, chromium, zinc, bismuth, titanium, vanadium, etc. Usually, conventionally known stocks that are described in "Aluminum Handbook", 4th ed., Society of Light Metals, 1990, for example, JIS A 1050, JIS A 3103, JIS A 3005, JIS A 1100 and JIS A 3004, may be employed either as such or after being alloyed with up to 5 wt % of magnesium in order to increase their tensile strength. The present invention is particularly suitable for roughening aluminum plates that are prone to the occurrence of defects due to directional differences in crystal grains.

The aluminum plate to be used in the present invention may be one manufactured by the ordinary direct casting method, as well as one produced by a continuous casting and rolling method. Examples of the continuous casting and rolling method include a two-roll method, a belt caster method and a block caster method. The aluminum plate to be used in the present invention has a thickness of about 0.1 to 0.6 mm.

The aluminum plate that is prone to the appearance of unevenness in treatment from the difference in the rate of aluminum dissolution in alkali etching due to the directional differences in crystal grains is preferably an aluminum plate manufactured by a process that eliminates either an intermediate annealing step or a soaking step or both steps from the direct casting method or an aluminum plate produced by a process that eliminates the intermediate annealing step from the continuous casting method.

The term "aluminum plate that is prone to the appearance of unevenness in treatment from the difference in the rate of aluminum dissolution in alkali etching due to the directional differences in crystal grains" refers to those aluminum plates in which "streaks" or grainy unevenness in surface quality are highly likely to occur after alkali etching.

The roughening method of the present invention is suitable for accomplishing uniform roughening of an aluminum alloy plate which, when examined with an AFM after it was buffed to provide a specular finished surface, alkali etched in an aqueous solution of sodium hydroxide in order to dissolve the aluminum plate in an amount of 15 g/m$^2$, and desmutted in an acidic aqueous solution, is found to have steps of 0.01 to 0.5 $\mu$m, preferably 0.02 to 0.2 $\mu$m, due to the difference in etch rate.

When the surface of an aluminum plate that has been buffed and etched with hydrofluoric acid is examined, crystal grains that are elongated in the direction of rolling have a width of from about 0.01 to 10 mm and a length of 0.5 to 300 mm. Preferably, the crystal grains elongated in the direction of rolling have a width of 5 mm or less, more preferably 3 mm or less.

The equipment to be used for AC or DC electrochemical roughening or electropolishing in the present invention may be any of the known apparatus that are conventionally used in performing continuous surface treatment of metal webs.

The aluminum plate roughened by the present invention is preferably hydrophilized in order to enhance the wear resistance of its surface.

After anodization or after anodization and hydrophilization, the aluminum plate is coated in the usual manner with a light-sensitive layer or both an intermediate layer and a light-sensitive layer, which are then dried to provide a PS plate having a good printing performance. The light-sensitive layer may be overlaid with a matte layer in order to ensure good contact with a lithographic film during vacuum exposure. A back coating layer may be provided on the reverse surface of the aluminum plate with a view to preventing aluminum from dissolving out during development. The present invention is adaptive not only to PS plates that are sensitized on one surface alone but also to those which are sensitized on both surfaces.

The present invention is applicable not only to the roughening of aluminum supports for lithographic printing plates but also to the roughening of every other type of aluminum plates.

Method of Preliminarily Forming Fine Asperities:

Forming fine asperities in the present invention means providing the surface of the aluminum plate with pits that have an average diameter of 1 Å to 0.5 $\mu$m and an average depth of 1 Å to 0.5 $\mu$m or fine asperities that have an average depth of 1 Å to 0.5 $\mu$m, an average pitch of 1 Å to 0.5 $\mu$m and an average length of 1 Å to 100 $\mu$m.

The fine asperities range in size from those which can be examined with an atomic force microscope or a scanning electron microscope to those of about several angstroms which are produced by rupturing an oxide film.

The methods of preliminarily forming fine asperities consist of the following three: the method of mechanically forming fine asperities on the aluminum surface; the method of chemically forming fine asperities; and the method of electrochemically forming fine asperities.

(1) Method of Preliminarily Forming Fine Asperities by Mechanical Means

The method of mechanically forming fine asperities on the aluminum surface may be by rubbing with a sponge, a brush, a roller or a buff. Alternatively, a roller having fine asperities on the surface may be pressed against the aluminum plate.

The time of treatment ranges preferably from 0.1 to 60 seconds. The load, impact and other forces to be exerted upon the aluminum plate can be determined within the range that permits the formation of the above-described asperities.

In the case of rubbing with a brush, it is preferred that the bristles have a length of 10 to 200 mm, the support of the bristles (where they are to be embedded) has a diameter of 100 to 1,000 mm, the bristles have a diameter of 0.1 to 2 mm, and the brush roll rotates at a speed of 10 to 1,000 rpm. The bristles may be formed of synthetic or natural fibers.

The direction in which fine asperities are formed mechanically may be perpendicular, parallel or at an angle to the direction of rolling the aluminum plate. Alternatively, fine asperities may be formed as if they draw circles or a load may be applied in random direction. It is preferred that fine asperities are formed as randomly as possible as seen microscopically.

In mechanical rubbing, an abrasive may or may not be used; non-use of an abrasive is particularly preferred. If any abrasive is to be used, a finest possible abrasive having an average grain size of no more than 1 $\mu$m should be used, preferably followed by rinse of the aluminum plate with water.

(2) Method of Preliminarily Forming Fine Asperities by Electrochemical Means

The method of forming fine asperities electrochemically is by electrochemical roughening in an acidic aqueous solution.

The acidic aqueous solution, equipment, power supply, current density, flow rate and temperature may be selected from among those which are used in known processes of electrochemical roughening and an aqueous solution based on nitric acid or hydrochloric acid is preferred. An AC or DC power supply is used in electrochemical roughening.

When fine asperities have been formed by electrochemical roughening, smut or an oxide film forms on the aluminum plate. Therefore, in order to ensure uniform electrochemical roughening in the next cycle, the aluminum plate is preferably lightly etched in an aqueous solution of an acid or an alkali to such an extent that it is dissolved in an amount of 0.01 to 3 g/m$^2$, more preferably in an amount of 0.1 to 1.5 g/m$^2$.

An AC or DC power supply may be used in electrochemical roughening and the amount of electricity which is responsible for an anode reaction to occur on the aluminum plate can be selected from the range of 1 to 2,000 C/dm$^2$, preferably 5 to 1,000 C/dm$^2$, more preferably 10 to 150 C/dm$^2$.

When preliminarily forming fine asperities in a HCl-based aqueous solution using an alternating current, it is particularly preferred that an aqueous solution having a temperature of 15 to 35° C. and containing 5 to 15 g/L of HCl is supplemented with an aluminum salt to give an aluminum ion concentration of 1 to 10 g/L.

When preliminarily forming fine asperities in a $HNO_3$-based aqueous solution using an alternating current, it is particularly preferred that an aqueous solution having a temperature of 60 to 90° C. and containing 5 to 15 g/of nitric acid is supplemented with an aluminum salt to give an aluminum ion concentration of 1 to 10 g/L.

When preliminarily forming fine asperities in a $HNO_3$-based aqueous solution using a direct current, it is particularly preferred that an aqueous solution having a temperature of 40 to 60° C. and containing 150 to 400 g/L of nitric acid is supplemented with an aluminum salt to give an aluminum ion concentration of 1 to 10 g/L.

The preliminarily forming fine asperities are preferably such that no areas of the aluminum plate remain unetched but that pits are uniformly produced on its entire surface; it is particularly preferred that any unetched areas are uniformly dispersed.

(3) Method of Preliminarily Forming Fine Asperities by Chemical Means

The method of forming fine asperities by chemical etching is preferably by immersing the aluminum plate in an aqueous solution of a mixture of hydrochloric acid and aluminum chloride to perform chemical etching. The aqueous solution of hydrochloric acid has preferably a concentration of 1 to 35 wt %, with aluminum ion being preferably dissolved to a concentration ranging from 1 g/L to saturation. The solution has preferably a temperature of 50 to 100° C., with the aluminum plate being immersed preferably for a time of 1 to 180 seconds.

Electropolishing in Aqueous Solution of Alkali:

The term "electropolishing in an aqueous solution of an alkali" as used in the present invention refers to the case of performing electrolysis on aluminum as anode using an aqueous solution of an alkaline substance alone as selected from among sodium hydroxide, potassium hydroxide, sodium carbonate and sodium phosphate, or a mixture of themselves, or a mixture of such alkaline substance with zinc hydroxide or aluminum hydroxide, or a mixture of such alkaline substance with a salt such as sodium chloride or potassium chloride and with such a combination of an electrolyte composition, a temperature and a concentration that an electrically deoxidizing material is provided. For consistent formation of a uniform oxide film, hydrogen peroxide, phosphate and so forth may be added at a concentration of no more than 1 wt %. Any aqueous solutions used in known cases of electropolishing may be employed and an aqueous solution based on sodium hydroxide is preferred. More preferred is an aqueous solution containing 2 to 30 wt % of sodium hydroxide and particularly preferred is an aqueous solution containing 3 to 20 wt % of sodium hydroxide. The temperature of the solution can be selected from the range of 10 to 90° C. (preferably 35 to 60° C.), the current density from the range of 1 to 200 A/dm$^2$ (preferably 20 to 80 A/dm$^2$), and the time of electrolysis from the range of 1 to 180 seconds. The current to be applied may be a direct current, a pulsed direct current or an alternating current, with a continuous direct current being preferred. The equipment for electrolysis may be a flat cell, a radial cell or any other apparatus that are commonly used in known cases of electrolysis.

After the treatment ends, straining with nip rollers and spraying with rinse water are preferably performed in order to ensure that the processing solution is not brought into the next step.

More preferably, chemical etching is performed in an aqueous solution of an acid or an alkali for dissolving the aluminum plate in an amount of 0.01 to 3 g/m$^2$ either before or after electropolishing or both before and after it.

Electropolishing in Acidic Aqueous Solution:

The electropolishing in an acidic aqueous solution as performed in the present invention permits the use of any aqueous solutions that are commonly used in known cases of electropolishing and an aqueous solution based on sulfuric acid or phosphoric acid is preferred. Particularly preferred is an aqueous solution containing 20 to 90 wt % (preferably 40 to 80 wt %) of sulfuric acid or phosphoric acid, The temperature of the solution can be selected from the range of 10 to 90° C. (preferably 50 to 80° C.), the current density from the range of 1 to 200 A/dm$^2$ (preferably 5 to 80 A/dm$^2$), and the time of electrolysis from the range of 1 to 180 seconds. The aforementioned aqueous solution may additionally contain 1 to 50 wt % of sulfuric acid, phosphoric acid, chromic acid, hydrogen peroxide, citric acid, boric acid, hydrofluoric acid, phthalic anhydride or the like. The aqueous solution may of course contain 0 to 10 wt % of not only aluminum but also any of the alloying components that are contained in aluminum alloys. The concentration of sulfate or phosphate ion and that of aluminum ion are preferably such that those ions will not precipitate at ambient temperature.

The current may be a direct current, a pulsed direct current or an alternating current, with a continuous direct current being preferred. The equipment for electrolysis may be a flat cell, a radial cell or any other apparatus that are commonly used in known cases of electrolysis. After the treatment ends, straining with nip rollers and spraying with rinse water are preferably performed in order to ensure that the processing solution is not brought into the next step.

More preferably, chemical etching is performed in an aqueous solution of an acid or an alkali for dissolving the aluminum plate in an amount of 0.01 to 3 g/m$^2$ either before or after electropolishing or both before and after it.

Chemical Etching in Aqueous Solution of Acid or Alkali:

The aqueous solution of an alkali has preferably a concentration of 1 to 30 wt % and may contain 0 to 10 wt % of not only aluminum but also any of the alloying components that are contained in aluminum alloys. A particularly preferred aqueous solution of an alkali is one based on sodium hydroxide. The treatment is preferably conducted at a solution temperature from ambient to 95° C. for a period of 1 to 120 seconds.

The acid that can be used in the acidic aqueous solution is selected from among phosphoric acid, nitric acid, sulfuric acid, chromic acid, hydrochloric acid and mixtures of two or more of these acids. The acidic aqueous solution has preferably a concentration of 0.5 to 65 wt % and may contain 0 to 10 wt % of not only aluminum but also any of the alloying components that are contained in aluminum alloys. The treatment is preferably conducted at a solution temperature from 30° C. to 95° C. for a period of 1 to 120 seconds. A particularly preferred acidic aqueous solution is sulfuric acid. The concentration of sulfuric acid and that of aluminum are preferably selected from such a range that they will not precipitate at ambient temperature.

After the etching treatment ends, straining with nip rollers and spraying with rinse water are preferably performed in order to ensure that the processing solution is not brought into the next step.

Desmutting in Acidic Aqueous Solution:

If chemical etching is performed with an aqueous solution of an alkali, smut usually forms on the surface of aluminum and must be removed by desmutting with phosphoric acid, nitric acid, sulfuric acid, chromic acid, hydrochloric acid or a mixture of two or more of these acids. The acidic aqueous solution has preferably a concentration of 0.5 to 60 wt %. Not only aluminum but also any of the alloying components that are contained in aluminum alloys may be dissolved in an amount of 0 to 5 wt % in the acidic aqueous solution. The treatment is preferably conducted at a solution temperature from ambient to 95° C. for a period of 1 to 120 seconds. After the desmutting end, straining with nip rollers and spraying with rinse water are preferably performed in order to ensure that the processing solution is not brought into the next step, Mechanical roughening:

Mechanical roughening is advantageously performed in the present invention using a rotating nylon brush roll having a bristle diameter of 0.2 to 1.61 mm and a liquid slurry that is supplied onto the surface of the aluminum plate. Any known abrasives may be used but siliceous sand, quartz, aluminum hydroxide or a mixture thereof is preferred. For details of these abrasives, see Unexamined Published Japanese Patent Application (kokai) Nos. 135175/1994 and 40047/1975. The liquid slurry has preferably a specific gravity of 1.05 to 1.3.

Needless to say, other approaches may be applied, as exemplified by the spray of a liquid slurry, use of a wire brush and transfer of a rough surface from a pressure roll onto the aluminum plate. For these and other approaches of mechanical roughening, see Unexamined Published Japanese Patent Application (kokai) Nos. 074898/1980, 162351/1986 and 104889/1988.

Aqueous Solution Based on Nitric Acid:

The aqueous solution based on nitric acid which is to be used in the present invention may be selected from among those which are used in ordinary cases of DC or AC electrochemical roughening. For this purpose, 1 to 500 g/L of an aqueous nitric acid solution may be supplemented with at least one member of nitric acid compounds containing nitrate ion such as aluminum nitrate, sodium nitrate and ammonium nitrate or at least one member of hydrochloric acid compounds containing hydrochloride ion such as aluminum chloride, sodium chloride and ammonium chloride, the compounds being added to give a concentration ranging from 1 g/L to saturation. The aqueous solution based on nitric acid may have dissolved therein various metals that are contained in aluminum alloys, as exemplified by iron, copper, manganese, nickel, titanium, magnesium and silica. A particularly preferred solution is such that aluminum chloride or aluminum nitrate is added to an aqueous solution of 5 to 20 g/L nitric acid to give an aluminum ion concentration of 3 to 50 g/L. The temperature of the solution is preferably at 10 to 100° C., more preferably at 40 to 90° C. Further, the temperature of the solution is preferably at 60 to 95° C. to produce the honeycomb pit having an average diameter of 0.1 to 0.5 $\mu$m.

Aqueous Solution Based on Hydrochloric Acid:

The aqueous solution based on hydrochloric acid which is to be used in the present invention may be selected from those which are used in ordinary cases of DC or AC electrochemical roughening. For this purpose, 1 to 100 g/L of an aqueous solution of hydrochloric acid may be supplemented with at least one member of nitric acid compounds containing nitrate ion such as aluminum nitrate, sodium nitrate and ammonium nitrate or at least one member of hydrochloric acid compounds containing hydrochloride ion such as aluminum chloride, sodium chloride and ammonium chloride, the compounds being added to give a concentration ranging from 1 g/L to saturation. The aqueous solution based on hydrochloric acid may have dissolved therein various metals that are contained in aluminum alloys, as exemplified by iron, copper, manganese, nickel, titanium, magnesium and silica. A particularly preferred solution is such that aluminum chloride or aluminum nitrate is added to an aqueous solution of 0.5 to 2 wt % hydrochloric acid to give an aluminum ion concentration of 3 to 50 g/L. The temperature of the solution is preferably at 10 to 60° C., more preferably at 15 to 50° C. Hypochlorous acid may be added to the solution.

When preliminarily forming fine asperities in a HCl-based aqueous solution using an alternating current, it is particularly preferred that an aqueous solution having a temperature of 15 to 45° C. and containing 5 to 15 g/L of HCl is supplemented with an aluminum salt to give an aluminum ion concentration of 3 to 50 g/L.

The additive to be added to the aqueous solution based on hydrochloric acid, equipment, power supply, current density, flow rate and temperature may be selected from among those which are used in known processes of electrochemical roughening and an aqueous solution based on nitric acid or hydrochloric acid is preferred. An AC or DC power supply is used in electrochemical roughening, with the former being particularly preferred.

The amount of electricity which is responsible for an anode reaction to occur on the aluminum plate as it is roughened electrochemically in an aqueous solution based on hydrochloric acid can be selected from the range of 1 to 300 C/dm$^2$, preferably 5 to 150 C/dm$^2$, more preferably 10 to 100 C/dm$^2$.

When fine asperities have been formed by electrochemical roughening, smut or an oxide film forms on the aluminum plate. Therefore, in order to ensure uniform electrochemical roughening in the next cycle, the aluminum plate is preferably lightly etched in an aqueous solution of an acid or an alkali to such an extent that it is dissolved in an a mount of 0.01 to 3 g/m$^2$, more preferably in an amount of 0.1 to 1.5 g/m$^2$.

When preliminary AC electrochemical roughening is done in an aqueous solution based on hydrochloric acid using electricity of 1 to 300 C/dm$^2$, it is preferred that no areas of the aluminum plate remain unetched but that pits are uniformly produced on its entire surface; it is particularly preferred that any unetched areas area uniformly dispersed.

Aqueous Solution Based on Nitric Acid:

The aqueous solution based on nitric acid which is to be used in the present invention may be selected from among those which are used in ordinary cases of DC or AC electrochemical roughening. For this purpose, 1 to 400 g/L of an aqueous nitric acid solution may be supplemented with at least one member of nitric acid compounds containing nitrate ion such as aluminum nitrate, sodium nitrate and ammonium nitrate or at least one member of hydrochloric acid compounds containing hydrochloride ion such as aluminum chloride, sodium chloride and ammonium chloride, said compounds being added to give a concentration ranging from 1 g/L to saturation. The aqueous solution based on nitric acid may have dissolved therein various metals that are contained in aluminum alloys, as exemplified by iron, copper, manganese, nickel, titanium, magnesium and silica. A particularly preferred solution is such that aluminum chloride or aluminum nitrate is added to an aqueous solution containing 5 to 20 g/L of nitric acid to give an aluminum ion concentration of 3 to 50 g/L. The temperature of the solution is preferably at 10 to 95° C., more preferably at 40 to 80° C.

AC Electrochemical Roughening:

The acidic aqueous solution to be used in the present invention may be selected from among those which are used in ordinary cases of DC or AC electrochemical roughening. Advantageously, it may be selected from the aforementioned aqueous solutions based on either nitric acid or hydrochloric acid.

The AC power supply to be used in electrochemical roughening may generate various waveforms including a sine wave, a rectangular wave, a trapezoidal wave and a triangular wave; among these, a rectangular wave and a trapezoidal wave are preferred, with a trapezoidal wave being particularly preferred. The frequency of the AC current is preferably 0.1 to 250 Hz.

A trapezoidal wave preferably used in the present invention is shown in FIG. 1. In a trapezoidal wave, the time tp for the current to increase from zero until it reaches a peak is preferably in the range of 0.1 to 10 msec, with the range of 0.3 to 2 msec being particularly preferred. The power supply circuit has such a great impedance that if tp is less than 0.1 msec, a high supply voltage is required for the current to rise to the peak and this increases the initial cost of the power supply. If tp is longer than 10 msec, the process is so sensitive to the effects of trace components in the electrolyte that it becomes difficult to achieve uniform roughening.

One cycle of the alternating current to be used in AC electrochemical roughening preferably satisfies the following conditions: tc/ta (ta is the time of anode reaction on the aluminum plate and tc is the time of cathode reaction) is 1 to 20; Qc/Qa (Qc is the amount of electricity for cathode reaction on the aluminum plate and Qa is the amount of electricity for anode reaction) is 0.3 to 20; and ta (time of anode reaction) is 5 to 1,000 msec. More preferably, tc/ta is in the range of 2.5 to 15 and Qc/Qa in the range of 2.5 to 15.

The current density as expressed by the peak value of a trapezoidal wave is preferably 10 to 200 A/dm$^2$ whether it is Ia (the current is in the anode cycle) or Ic (in the cathode cycle). The value of Ic/Ia is preferably in the range of 0.3 to 20.

At the point in time when electrochemical roughening has ended, the total sum of the amount of electricity responsible for the anode reaction to take place on the aluminum plate is preferably 1 to 1,000 C/dm$^2$.

The electrolytic cell to be used in the present invention for performing AC electrochemical roughening may be any of the electrolytic cells that are employed in known cases of surface treatment, as exemplified by a vertical type, a flat type and a radial type, and a radial electrolytic cell of the type described in Unexamined Published Japanese Patent Application (kokai) No. 195300/1993 is particularly preferred. The direction of the electrolyte flowing through the electrolytic cell may be parallel or counter to the progress of the web of aluminum plate. One electrolytic cell may be connected to one or more AC power supplies. Two or more electrolytic cells may be employed.

Figure 2:
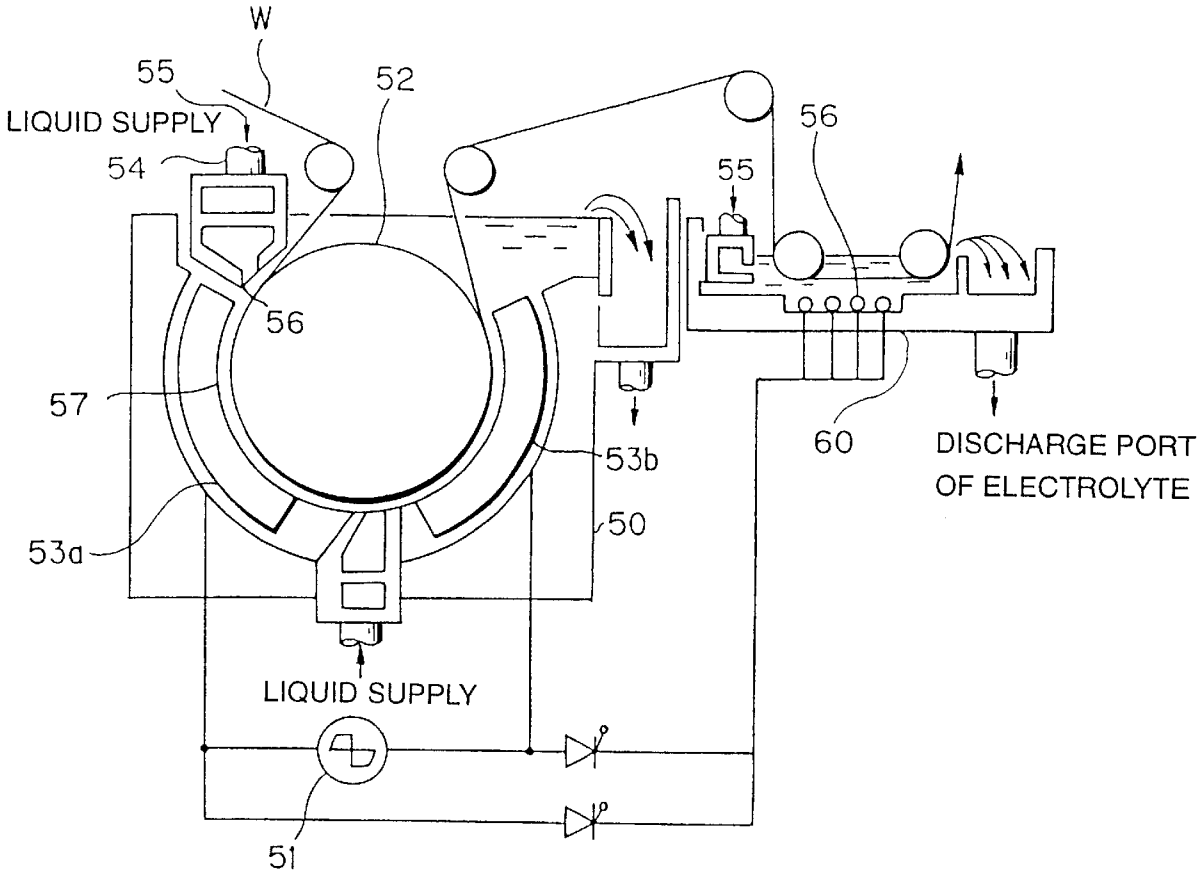
FIG. 2 shows diagrammatically an example of the electrolytic apparatus for use in the step of electrochemical roughening in the process of the present invention.

An apparatus of the type shown in FIG. 2 may be used in AC electrochemical roughening. If two or more electrolytic cells are to be used, electrolysis may be performed under the same or different conditions.

A web of aluminum plate W is wrapped onto a radial drum roller 52 immersed in a main electrolytic cell 50 and as it is transported, the web is electrolyzed with main electrodes 53*a* and 53*b* connected to an AC power supply 51. Electrolyte 55 supplied from an inlet 54 passes through a slit 56 to be fed into a passageway 57 between the radial drum roller 52 and each of the main electrodes 53*a* and 53*b*. The web of aluminum plate W thus treated in the main electrolytic cell 50 is then transferred into an auxiliary anodic cell 60, where it is subjected to further electrolysis. The auxiliary anodic cell 60 has an auxiliary anode 58 placed to face the web of aluminum plate W and the electrolyte 55 is supplied to flow between the auxiliary anode 58 and the web W.

DC Electrochemical Roughening:

The term "DC electrochemical roughening" as used herein means a process in which a direct current is applied between the aluminum plate and an opposed electrode to perform electrochemical roughening. The electrolyte may be selected from among those which are used in known cases of DC or AC electrochemical roughening. Advantageously, the electrolyte may be selected from among the aforementioned aqueous solutions based on either nitric acid or hydrochloric acid. The temperature of the solution is preferably at 10 to 80° C. Any known DC electrochemical roughening apparatus may be employed and a preferred one is described in Unexamined Published Japanese Patent Application (kokai) No. 141094/1989, which comprises one or more alternating pairs of an anode and a cathode, Other known apparatus are described in Japanese Patent Application Nos. 68204/1993, 205657/1994 and 21050/1994, as well as Unexamined Published Japanese Patent Application (kokai) No. 19115/1986 and Examined Japanese Patent Publication (kokoku) No. 44760/1982. Alternatively, electrochemical roughening may be performed with a direct current being applied between a conductor roll in contact with the aluminum plate and a counter cathode, and with the aluminum plate used as anode. After the end of electrolysis, straining with nip rollers and spraying with rinse water are preferably performed in order to ensure that the processing solution is not brought into the next step. The direct current to be used in electrochemical roughening is preferably such that the ripple content is no more than 20%. The current density is preferably 10 to 200 A/dm$^2$ and the amount of electricity for the aluminum plate used as anode is preferably 1 to 1,000 C/dm$^2$. The anode may be selected from among known oxygenating electrode materials including ferrite, iridium oxide, platinum, and valve metals (i.e., titanium, niobium and zirconium) clad or plated with platinum. The cathode may be selected from among carbon, platinum, titanium, niobium, zirconium, stainless steel and electrode materials for use as cathode in fuel cells.

Anodization:

The aluminum plate is anodized to have increased wear resistance on the surface. The electrolyte to be used in anodizing the aluminum plate may be selected from among any substances that are capable of forming porous oxide films. Generally, sulfuric acid, phosphoric acid, oxalic acid, chromic acid or mixtures thereof are used. The concentration of the electrolyte is determined as appropriate for the type of the electrolyte used. The conditions for anodization are variable with the electrolyte to be used and cannot be specified uniquely. Generally, satisfactory results are obtained under the following conditions: electrolyte's concentration, 1 to 80 wt %; its temperature, 5 to 70° C.; current density, 1 to 60 A/dm$^2$; voltage, 1 to 100 V; and time of electrolysis, 10 to 300 seconds.

Anodization is usually performed with a direct current but an alternating current may of course be impressed. An anodic oxide film is suitably formed in an amount of 1 to 10 g/m$^2$. If less than 1 g/m$^2$ of an anodic oxide film is formed, the resulting lithographic printing plate has only a poor printing durability or the non-image area of the plate is prone to be damaged and so-called "flaw stain" (ink adheres to the damaged area) is likely to occur.

After anodization, the aluminum surface may optionally be hydrophilized. For the purposes of the present invention, hydrophilization may be performed by an alkali metal silicate (e.g. sodium silicate in aqueous solution) method of the types described in U.S. Pat. Nos. 2,714,066, 3,181,461, 3,260,734 and 3,902,734. In this method, the support is either immersed or electrolyzed in an aqueous solution of sodium silicate. Other methods that can be used are a treatment with potassium fluorozirconate as described in Examined Japanese Patent Publication (kokoku) No. 22063/1988 and a treatment with polyvinyl phosphoric acid as described in U.S. Pat. Nos. 3,276,868, 4,153,461 and 4,689,272.

Also preferred is a procedure in which the pores produced in graining and anodization are sealed. The sealing of pores may be performed by, for example, immersing in a hot aqueous solution containing hot water and an inorganic or organic salt and exposure to a steam bath.

The aluminum plate roughened by the method of the present invention is a support characterized in that physical properties as measured by the methods described in Japanese Patent Application Nos. 296708/1996 and 176568/1996 satisfy the following values. Specifically, the support satisfies the following surface morphological features.

(1) The surface morphology as defined in terms of the values measured with AFM (atomic force microscope) is within the following ranges:

(i) the value of a/b (specific surface) is in the range of 1.15 to 1.5, where a is the surface area determined by an approximate three-point method and b is the projected area of the top portion, both being based on the result of measurements within a square of 100 μm per side using an AFM having a resolving power of 0.1 μm in a horizontal (X,Y) direction;

(ii) an average surface roughness as measured within a square of 240 μm per side using an AFM having a resolving power of 1.9 μm in a horizontal (X,Y) direction is in the range of 0.3 to 1.5 μm;

(iii) the proportion in which the gradient as measured within a square of 240 μm×240 μm using an AFM having a resolving power of 1.9 μm in a horizontal (X,Y) direction is at least 30 degrees is in the range of 5 to 40%;

(iv) a support for lithographic printing plates which is an aluminum plate roughened to have high and low spots on the surface, characterized in that the proportion in which the gradient of a surface gradient distribution as measured within a square of 50 μm×50 μm using an atomic force microscope having a resolving power of 0.1 μm is in the range of 5 to 50%, (2) the 85° gloss as specified in JIS Z9741-1983 and which is measured before application of a light-sensitive layer is no more than 30;

(3) the proportion of the area occupied by honeycomb pits having an average diameter of 0.1 to 3 μm within a visual field of 80 μm upon examination with a scanning electron microscope at a magnification of 750 is 80 to 100%;

(4) the fractal dimension as determined by a box-counting method, a scale transformation method, a cover method, a rotating radius method, a density correlation function method or the like within a square of 100 μm×100 μm or 240 μm×240 μm per side using an AFM having a resolving power of 0.1 μm or 1.9 μm in a horizontal (X,Y) direction.

The aluminum plate roughened by the method of the present invention is a support which, prior to application of a light-sensitive layer, has the following values of the surface roughness properties specified in JIS B0601-1994 (average surface roughness Ra, 0.3 to 1 μm; average distance between local peaks, S, 1 to 80 μm; and average distance between high and low spots, Sm, 1 to 80 μm) and which has good adhesion in the image area, as well as a long press life.

The aluminum plate roughened by the method of the present invention is a support which, prior to anodization, has the following values of the colors specified in JIS Z8729-1980 ($90<L^*<95$, $\Delta Eab^* \leqq 1$) and which is white, suffers from only limited unevenness in treatment and allows for efficient layout proofing.

The aluminum plate roughened by the method of the present invention is a support for lithographic printing plates which, prior to application of a light-sensitive layer, has the following values of the glosses specified in JIS Z9741-1983 (85° gloss≦40; 75° gloss≦15; 60° gloss≦10; 45° gloss≦10; and 20° gloss≦5). Thus, it is a support allowing the press operator to have an easy access to checking the quantity of dampening water in the non-image area during printing.

EXAMPLES

The following examples are provided for the purpose of further illustrating the present invention.

Example 1

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the development of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.48 mm. The bristles were closely embedded in the sidewall of a stainless steel cylinder having a diameter of 300 mm. Two support rollers (200 mm$^{\Phi}$) were spaced apart by 300 mm under the brushes. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 6 g/m$^2$. After the etching, the aluminum plate was rinsed with water.

(3) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(4) Electrochemical Roughening in Aqueous Solution of Hydrochloric Acid (to Form Fine Asperities)

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 25 C/dm$^2$ in terms of the total sum of electricity applied to the aluminum plate working as anode. Five percent of the current from the power supply was shunted to the auxiliary anode.

After the electrochemical roughening, the aluminum plate was sprayed with rinse water.

(5) Etching in Aqueous Solution of Alkali

The aluminum plate was etched by being immersed in an aqueous solution containing 5 wt % of NaOH and 0.5 wt % of aluminum ion at 45° C. The aluminum plate dissolved in respective amounts of 0.1 g/m$^2$ (Example 1-1), 0.3 g/m$^2$ (Example 1-2), 0.7 g/m$^2$ (Example 1-3) and 1.1 g/m$^2$ (Example 1-4). After the etching, the aluminum plates were rinsed with water.

(6) Desmutting

Subsequently, the aluminum plates were desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plates were rinsed with water.

(7) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plates were roughened electrochemically with a carbon electrode being used as a counter electrode. The auxiliary anode was made of ferrite.

The current density was 50 A/dm$^2$ in terms of a peak current value and the amount of electricity was 65 C/dm$^2$ in terms of the total sum of electricity applied to the aluminum plate working as anode. Five percent of the current from the power supply was shunted to the auxiliary anode. After the electrochemical roughening, the aluminum plates were sprayed with rinse water.

(8) Electropolishing in Aqueous Solution of Alkali

The aluminum plates, used as anode, were electropolished in an aqueous solution containing 9 wt % of sodium hydroxide and 0.5 wt % of aluminum ion at 35° C. The current density was 20 A/dm$^2$ and aluminum dissolved in an amount of 4 g/m$^2$.

(9) Desmutting

After the electropolishing, the aluminum plates were rinsed with water. Subsequently, they were desmutted by being immersed in an aqueous solution containing 25 wt % of sulfuric acid at 60° C. Thereafter, the aluminum plates were rinsed with water.

(10) Anodizing

The aluminum plates were anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 2.4 g/m$^2$. After the anodizing, the aluminum plates were sprayed with rinse water.

The thus treated aluminum plates had neither streaks nor grainy unevenness in surface quality that would have otherwise occurred on the surface due to directional differences in crystal grains. The plates had an average surface roughness of ca. 0.6 $\mu$m.

An intermediate layer and a light-sensitive layer were applied to the aluminum plates and dried to produce positive-working PS plates each having a dry film thickness of 2.0 g/m$^2$. The PS plates turned out to be good printing plates on press.

Example 2

The aluminum plate as anodized in Example 1-2 was hydrophilized by being immersed in an aqueous solution of 2.5 wt % sodium silicate at 70° C. for 14 seconds. Thereafter, the aluminum plate was sprayed with rinse water and dried. After each of the treatments and water rinses, straining was effected with nip rollers.

An intermediate layer and a light-sensitive layer were applied to the thus treated aluminum plate and dried to produce a positive-working PS plate, which turned out to be a good printing plate on press.

Example 3

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the development of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.48 mm. The bristles were closely embedded in the sidewall of a stainless steel cylinder having a diameter of 300 mm. Two support rollers (200 mm$^{\Phi}$) were spaced apart by 300 mm under the brushes. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 10 g/m$^2$. After the etching, the aluminum plate was rinsed with water.

(3) Desmutting

Subsequently, the aluminum plate was desmutted by being immersed in an aqueous solution containing 1 wt % of hydrochloric acid at 35° C. for 10 second. After the desmutting, the aluminum plate was rinsed with water.

(4) Electrochemical Roughening in Aqueous Solution of Hydrochloric Acid (to Form Fine Asperities)

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 25 C/dm$^2$ in terms of the total sum of electricity applied to the aluminum pate working as anode. Five percent of the current from the power supply was shunted to the auxiliary anode.

After the electrochemical roughening, the aluminum plate was sprayed with rinse water.

(5) Etching in Aqueous Solution of Alkali

The aluminum plate was etched by being immersed in an aqueous solution containing 5 wt % of NaOH and 0.5 wt % of aluminum ion at 45° C. The aluminum plate dissolved in an amount of 1.1 g/m$^2$. After the etching, the aluminum plate was rinsed with water.

(6) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(7) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as counter electrode. The auxiliary anode was made of ferrite.

The current density was 50 A/dm$^2$ in terms of a peak current value and the amount of electricity in terms of the total sum of electricity applied to the aluminum plate working as anode was 100 C/dm$^2$ (Example 3-1), 150 C/dm$^2$ (Example 3-2) or 200 C/dm$^2$ (Example 3-3). Five percent of the current from the power supply was shunted to the auxiliary anode. After the electrochemical roughening, the aluminum plates were sprayed with rinse water.

(8) Etching in Aqueous Solution of Alkali

The aluminum plates were etched by being immersed in an aqueous solution containing 27 wt % of NaOH and 6.5 wt % of aluminum ion at 40° C. The aluminum plates dissolved in an amount of 1 g/m$^2$. After the etching, the aluminum plates were rinsed with water.

(9) Desmutting

After the etching, the aluminum plates were desmutted by being immersed in an aqueous solution containing 25 wt % of sulfuric acid at 60° C. After the desmutting, the aluminum plates were rinsed with water.

(10) Anodizing

The aluminum plates were anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 2.4 g/m$^2$. After the anodizing, the aluminum plates were sprayed with rinse water.

The thus treated aluminum plates had neither streaks nor grainy unevenness in surface quality that would have otherwise occurred on the surface due to directional differences in crystal grains. The plates had an average surface roughness of 0.6 $\mu$m.

The aluminum plate of Example 3-2 was measured for L* prior to anodizing and the result was 93. Other characteristic values were as follows: S, 49 $\mu$m; Sm, 46 $\mu$m; 85° gloss, 20; 75° gloss, 2; 60° gloss, 2; 45° gloss, 3; 20° gloss, 1.

An intermediate layer and a light-sensitive layer were applied to the aluminum plates and dried to produce positive-working PS plates each having a dry film thickness of 2.0 g/m$^2$. The PS plates turned out to be good printing plates on press.

Example 4

The aluminum plates as anodized in Example 3-1 and Example 3-2 were hydrophilized by being immersed in an aqueous solution of 2.5 wt % sodium silicate at 70° C. for 14 seconds. Thereafter, the aluminum plates were sprayed with rinse water and dried. After each of the treatments and water rinses, straining was effected with nip rollers.

An intermediate layer and a negative-working light-sensitive layer were applied to the thus treated aluminum plates and dried to produce PS plates, which turned out to be good printing plates on press.

Example 5

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the development of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.48 mm. The bristles were closely embedded in the sidewall of a stainless steel cylinder having a diameter of 300 mm. Two support rollers (200 mm$^{\Phi}$) were spaced apart by 300 mm under the brushes. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing aluminum plate was 50 m/min.

(2) Etching in Aqueous Solution of Alkali

The aluminum plate was etched by being immersed in an aqueous solution containing 27 wt % of NaOH and 6.5 wt % of aluminum ion t 70° C. The aluminum plate dissolved in an amount of 10 g/m$^2$. After the etching, the aluminum plate was rinsed with water.

(3) Mechanically Producing Fine Asperities

The aluminum plate was rubbed with a water-moistened nylon sponge moving in a direction perpendicular to the direction of rolling. As a result, fine asperities were formed on the aluminum surface.

(4) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 second. After the desmutting, the aluminum plate was rinsed with water.

(5) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 175 C/dm$^2$ in terms of the total sum of electricity applied to the aluminum plated working as anode. Five percent of the current from the power supply was shunted to the auxiliary anode. After the electrochemical roughening, the aluminum plate was sprayed with rinse water.

(6) Etching in Aqueous Solution of Alkali

The aluminum plate was etched by being immersed in an aqueous solution containing 27 wt % of NaOH and 6.5 wt % of aluminum ion at 40° C. The aluminum plate dissolved in an amount of 1 g/m$^2$. After the etching, the aluminum plate was rinsed with water.

(7) Desmutting

Thereafter, the aluminum plate was rinsed with water. Subsequently, the aluminum plate was desmutted by being immersed in an aqueous solution containing 25 wt % sulfuric acid at 60° C. After the desmutting, the aluminum plate was rinsed with water.

(8) Anodizing

The aluminum plate was anodized in an aqueous solution of 15 wt % sulfuric acid (containing 0.5 wt % of aluminum ion) at 35° C. using a DC voltage at a current density of 2 $A/dm^2$ until an anodic oxide film formed in an amount of 2.4 $g/m^2$. After the anodizing, the aluminum plate was sprayed with rinse water.

The thus treated aluminum plate had neither streaks nor grainy unevenness in surface quality that would have otherwise occurred on the surface due to directional differences in crystal grains. The plate had an average surface roughness of ca. 0.6 $\mu$m.

An intermediate layer and a light-sensitive layer were applied to the aluminum plate and dried to produce a positive-working PS plate having a dry film thickness of 2.0 $g/m^2$. The PS plate turned out to be a good printing plate on press.

Example 6

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the development of streaks and grainy unevenness in surface quality. The plate was subjected to the following consecutive steps.

(1) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 3 $g/m^2$. After the etching, the aluminum plate was-rinsed with water.

(2) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(3) Electrochemical Roughening in Aqueous Solution of Hydrochloric Acid (to Form Fine Asperities)

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 $A/dm^2$ in terms of a peak current value and the amount of electricity was 25 $C/dm^2$ in terms of the total sum of electricity applied to the aluminum plate working as anode. Five percent of the current from the power supply was shunted to the auxiliary anode.

After the electrochemical roughening, the aluminum plate was sprayed with rinse water.

(4) Etching in Aqueous Solution of Alkali

The aluminum plate was etched by being immersed in an aqueous solution containing 5 wt % of NaOH and 0.5 wt % of aluminum ion at 45° C. The aluminum plate dissolved in an amount of 0.3 $g/m^2$. After the etching, the aluminum plate was rinsed with water.

(5) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(6) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % of nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 $A/dm^2$ in terms of a peak current value and the amount of electricity in terms of the total sum of electricity applied to the aluminum plate working as anode was 180 $C/dm^2$ (Example 6-1), 230 $C/dm^2$ (Example 6-2) or 500 $C/dm^2$ (Example 6-3). Five percent of the current from the power supply was shunted to the auxiliary anode. After the electrochemical roughening, the aluminum plates were sprayed with rinse water.

(7) Etching in Aqueous Solution of Alkali

The aluminum plates were etched by being immersed in an aqueous solution containing 27 wt % of NaOH and 6.5 wt % of aluminum ion at 40° C. The aluminum plates dissolved in an amount of 0.1 $g/m^2$. After the etching, the aluminum plates were rinsed with water.

(8) Desmutting

After the etching, the aluminum plates were desmutted by being immersed in an aqueous solution containing 25 wt % of sulfuric acid at 60° C. After the desmutting, the aluminum plates were rinsed with water.

(9) Anodizing

The aluminum plates were anodized in an aqueous solution of 15 wt % sulfuric acid (containing 0.5 wt % of aluminum ion) at 35° C. using a DC voltage at a current density of 2 $A/dm^2$ until an anodic oxide film formed in an amount of 2.4 $g/m^2$. After the anodizing, the aluminum plates were sprayed with rinse water.

The thus treated aluminum plates had neither streaks nor grainy unevenness in surface quality that would have otherwise occurred on the surface due to directional differences in crystal grains.

An intermediate layer and a light-sensitive layer were applied to the aluminum plates and dried to produce positive-working PS plates each having a dry film thickness of 2.0 $g/m^2$. The PS plates turned out to be good printing plates on press.

Example 7

The aluminum plates as anodized in Example 6-1, Example 6-2 and Example 6-3 were hydrophilized by being immersed in an aqueous solution of 2.5 wt % sodium silicate at 70° C. for 14 seconds. Thereafter, the aluminum plates were sprayed with rinse water and dried. After each of the treatments and water rinses, straining was effected with nip rollers.

An intermediate layer and a negative-working light-sensitive layer were applied to the thus treated aluminum plates and dried to produce PS plates, which turned out to be good printing plates on press.

Example 8

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.48 mm. The bristles were closely embedded in the sidewall of a stainless steel cylinder having a diameter of 300 mm. Two support rollers (200 $mm^{\Phi}$) were spaced apart by 300 mm under the brushes. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 9 $g/m^2$. After the etching, the aluminum plate was rinsed with water.

(3) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(4) Electrochemical Roughening in Aqueous Solution of Hydrochloric Acid (to Form Fine Asperities)

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 $A/dm^2$ and the amount of electricity was 25 $C/dm^2$ in terms of the total sum of electricity applied to the aluminum plates working as anode. Five percent of the current from the power supply was shunted to the auxiliary anode.

After the electrochemical roughening, the aluminum plate was sprayed with rinse water.

(5) Etching in Aqueous Solution of Alkali

The aluminum plate was etched by being immersed in an aqueous solution containing 5 wt % of NaOH and 0.5 wt % of aluminum ion at 45° C. The aluminum plate dissolved in an amount of 0.3 $g/m^2$. After the etching, the aluminum plate was rinsed with water.

(6) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(7) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % nitric acid (containing 0.5 wt % of aluminum ion and 0.007 wt % of ammonium ion) at 80° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 $A/dm^2$ in terms of a peak current value and the amount of electricity in terms of the total sum of electricity applied to the aluminum plate working as anode was 50 $C/dm^2$ (Example 8-1), 100 $C/dm^2$ (Example 8-2) or 150 $C/dm^2$ (Example 8-3). Five percent of the current from the power supply was shunted to the auxiliary anode. After the electrochemical roughening, the aluminum plates were sprayed with rinse water.

(8) Etching in Aqueous Solution of Alkali

The aluminum plates were etched by being immersed in an aqueous solution containing 5 wt % of NaOH and 0.5 wt % of aluminum ion at 45° C. The aluminum plates dissolved in an amount of 0.2 $g/m^2$. After the etching, the aluminum plates were rinsed with water.

(9) Desmutting

After the etching, the aluminum plates were rinsed with water. Subsequently, they were desmutted by being immersed in an aqueous solution containing 25 wt % of sulfuric acid at 60° C. Thereafter, the aluminum plats were rinsed with water.

(10) Anodizing

The aluminum plates were anodized in an aqueous solution of 15 wt % sulfuric acid (containing 0.5 wt % of aluminum ion) at 35° C. using a DC voltage at a current density of 2 $A/dm^2$ until an anodic oxide film formed in an amount of 2.4 $g/m^2$. After the anodizing, the aluminum plates were sprayed with rinse water.

The thus treated aluminum plates had neither streaks nor grainy unevenness in surface quality that would have otherwise occurred on the surface due to directional differences in crystal grains. The plates had an average surface roughness of ca. 0.6 $\mu$m.

An intermediate layer and a light-sensitive layer were applied to the aluminum plates and dried to produce positive-working PS plates each having a dry film thickness of 2.0 $g/m^2$. The PS plates turned out to be good printing plates on press.

Example 9

The aluminum plate as anodized in Example 8-1 was hydrophilized by being immersed in an aqueous solution of 2.5 wt % sodium silicate at 70° C. for 14 seconds. Thereafter, the aluminum plate was sprayed with rinse water and dried. After each of the treatments and water rinses, straining was effected with nip rollers.

An intermediate layer and a negative-working light-sensitive layer were applied to the thus treated aluminum plate and dried to produce a PS plate, which turned out to be a good printing plates on press.

Comparative Example 1

An aluminum plate was roughened as in Example 1 except that neither of the steps (3), (4) and (5) were performed. The thus treated aluminum plate had streaks and grainy unevenness in surface quality developing on the surface due to directional differences in crystal grains.

According to the present invention, a method of producing an aluminum support for a lithographic printing plate that is less prone to the appearance of "streaks" or "grainy unevenness in surface quality" which are defects that would otherwise occur from the difference in the rate of aluminum dissolution due to directional differences in crystal grains can be provided consistently and at low cost.

Example 10

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.48 mm. The bristles were closely embedded in the sidewall of a stainless steel cylinder having a diameter of 300 mm. Two support rollers (100 mmϕ) were spaced apart by 300 mm under the brushed. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 10 g/m$^2$. After the etching, the aluminum plate was rinsed with water.

(3) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(4) Preliminary Electrochemical Roughening in Aqueous Solution of Hydrochloric Acid Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 40 C/dm$^2$ in terms of the total sum of electricity applied to the aluminum plate working as anode. Five percent of the current from the power supply was shunted to the auxiliary anode. After the electrochemical roughening, the aluminum plate was sprayed with rinse water.

(5) Electropolishing in Aqueous Solution of Alkali

The aluminum plate, used as anode, was electropolished by being immersed in an aqueous solution containing 9 wt % of NaOH and 0.5 wt % of aluminum ion at 35° C. The current density was 20 A/dm$^2$ and aluminum dissolved in an amount of 4 g/m$^2$.

(6) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(7) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 230 C/dm$^2$ in terms of the total sum of electricity applied to the aluminum plate working as anode. Five percent of the current from the power supply was shunted to the auxiliary anode. After the electrochemical roughening, the aluminum plate was sprayed with rinse water.

(8) Etching in Aqueous Solution of Alkali

The aluminum plate was etched in an aqueous solution containing 26 wt % of sodium hydroxide and 6.5 wt % of aluminum ion at 45° C. The aluminum dissolved in an amount of 1 g/m$^2$. After the etching, the aluminum plate was rinsed with water.

(9) Desmutting

After the etching, the aluminum plate was rinsed with water. Subsequently, it was desmutted by being immersed in an aqueous solution containing 25 wt % of sulfuric acid at 60° C. Thereafter, the aluminum plate was rinsed with water.

(10) Anodizing

The aluminum plate was anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 2.4 g/m$^2$. After the anodizing, the aluminum plate was sprayed with rinse water.

The thus treated aluminum plate had neither streaks nor grainy unevenness in surface quality that would have otherwise occurred on the surface due to directional differences in crystal grains. The plate had an average surface roughness of ca. 0.6 $\mu$m.

An intermediate layer and alight-sensitive layer were applied to the aluminum plate and dried to produce a positive-working PS plate having a dry film thickness of 2.0 $g/m^2$. The PS plate turned out to be a good printing plate on press.

Example 11

The aluminum plate as anodized in Example 10 was hydrophilized by being immersed in an aqueous solution of 2.5 wt % sodium silicate at 70° C. for 14 seconds. Thereafter, the aluminum plate was sprayed with rinse water and dried. After each of the treatments and water rinses, straining was effected with nip rollers.

An intermediate layer and a negative-working light-sensitive layer were applied to the thus treated aluminum plate and dried to produce a PS plate, which turned out to be a good printing plate on press.

Example 12

An aluminum plate was roughened as in Example 10, except that the chemical etching in the aqueous alkali solution in (8) of Example 1 was replaced by electropolishing in an aqueous solution containing 9 wt % of sodium hydroxide and 0.5 wt % of aluminum ion at 35° C. and at a current density of 20 $A/dm^2$, with the aluminum plate used as anode, such that 1 $g/m^2$ of aluminum dissolved. An intermediate layer and a negative-working light-sensitive layer were applied to the thus treated aluminum plate and dried to produce a PS plate, which turned out to be a good printing plate on press.

Example 13

The aluminum plate as anodized in Example 12 was hydrophilized by being immersed in an aqueous solution of 2.5 wt % of sodium silicate at 70° C. for 14 seconds. Thereafter, the aluminum plate was sprayed with rinse water and dried. After each of the treatments and water rinses, straining was effected with nip rollers.

An intermediate layer and a negative-working light-sensitive layer were applied to the thus treated aluminum plate and dried to produce a PS plate, which turned out to be a good printing plate on press.

Example 14

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality.

The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.295 mm. The bristles were closely embedded in the sidewall of a stainless steel cylinder having a diameter of 300 mm. Two support rollers (100 $mm^{\Phi}$) were spaced apart by 300 mm under the brushes. Each brush roller was pressed against the aluminum plate until the load of a motor driving the brush to rotate was 4 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 6 $g/m^2$. After the etching, the aluminum plate was rinsed with water.

(3) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(4) Preliminary Electrochemical Roughening in Aqueous Solution of Hydrochloric Acid Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 $A/dm^2$ in terms of a peak current value and the amount of electricity in terms of the total sum of electricity applied to the aluminum plate working as anode was 25 $C/dm^2$ (Example 14-1), 40 $C/dm^2$ (Example 14-2), 100 $C/dm^2$ (Example 14-3), or 150 $C/dm^2$ (Example 14-4). Five percent of the current from the power supply was shunted to the auxiliary anode.

After the electrochemical roughening, the aluminum plates were sprayed with rinse water.

(5) Etching in Aqueous Solution of Alkali

The aluminum plates were etched by being immersed in an aqueous solution containing 26 wt % of NaOH and 6.5 wt % of aluminum ion at. 45° C. The aluminum plates dissolved in an amount of 0.3 $g/m^2$. After the etching, the aluminum plates were rinsed with water.

(6) Desmutting

Subsequently, the aluminum plates were desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plates were rinsed with water.

(7) Electrochemical Roughening in Aqueous Solution of Nitric Acid

Electrochemical roughening was performed continuously using an AC voltage of the waveform shown in FIG. 1 and two units of the apparatus shown in FIG. 2. The electrolytes was an aqueous solution of 1 wt % nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as counter electrode. The auxiliary anode was made of ferrite.

The current density was 50 $A/dm^2$ in terms of a peak current value and the amount of electricity was 65 $C/dm^2$ in terms of the total sum of electricity applied to the aluminum plate working as anode. Five percent of the current from the power supply was shunted to the auxiliary anode. After the electrochemical roughening, the aluminum plates were sprayed with rinse water.

(8) Etching in Aqueous Solution of Alkali

The aluminum plates were etched by being immersed in an aqueous solution containing 27 wt % of NaOH and 6.5 wt % of aluminum ion at 40° C. The aluminum plates dissolved in an amount of 1 g/m$^2$. After the etching, the aluminum plates were rinsed with water.

(9) Desmutting

After the etching, the aluminum plates were desmutted by being immersed in an aqueous solution containing 25 wt % of sulfuric acid at 60° C. After the desmutting, the aluminum plates were rinsed with water.

(10) Anodizing

The aluminum plates were anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 1.2 g/m$^2$. After the anodizing, the aluminum plates were sprayed with rinse water.

The thus treated aluminum plates had neither streaks nor grainy unevenness in surface quality that would have otherwise occurred on the surface due to directional differences in crystal grains. The plates had an average surface roughness of ca. 0.35 $\mu$m.

An intermediate layer and a light-sensitive layer were applied to the aluminum plates and dried to produce proofing positive-working PS plates each having a dry film thickness of 2.0 g/m$^2$. Using these PS plates, printing was done on a proofing press and the following good results were obtained; smooth movement of a sponge for replenishing dampening water and high ink receptivity.

Example 15

An aluminum plate was roughening as in Example 5, except that the chemical etching in the aqueous alkali solution in (8) of Example 14 was replaced by electropolishing in an aqueous solution containing 9 wt % of sodium hydroxide and 0.5 wt % of aluminum ion at 35° C. at a current density of 20 A/dm$^2$, with the aluminum plate used as an anode, such that 4 g/m$^2$ of aluminum dissolved. An intermediate layer and a negative-working light-sensitive layer were applied to the thus treated aluminum plate and dried to produce a PS plate, which turned out to be a good printing plate on press.

Example 16

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality. The plate was subjected to the following consecutive steps.

(1) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 3 g/m$^2$. After the etching, the aluminum plate was rinsed with water.

(2) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(3) Electrochemical Roughening in Aqueous Solution of Hydrochloric Acid (to Form Fine Asperities)

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 50 C/dm$^2$ in terms of the total sum of electricity applied to the aluminum plate working as anode. Five percent of the current from the power supply was shunted to the auxiliary anode. After the electrochemical roughening, the aluminum plate was sprayed with rinse water.

(4) Etching in Aqueous Solution of Alkali

The aluminum plate was etched by being immersed in an aqueous solution containing 5 wt % of NaOH and 0.5 wt % of aluminum ion at 45° C. The aluminum plate dissolved in an amount of 0.3 g/m$^2$. After the etching, the aluminum plate was rinsed with water.

(5) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(6) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % of nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity in terms of the total sum of electricity applied to the aluminum plate working as anode was 180 C/dm$^2$ (Example 16-1), 230 C/dm$^2$ (Example 16-2) or 500 C/dm$^2$ (Example 16-3). Five percent of the current from the power supply was shunted to the auxiliary anode. After the electrochemical roughening, the aluminum plates were sprayed with rinse water.

(7) Etching in Aqueous Solution of Alkali

The aluminum plates were etched by being immersed in an aqueous solution containing 27 wt % of NaOH and 6.5 wt % of aluminum ion at 40° C. The aluminum plates dissolved in an amount of 0.1 g/m$^2$. After the etching, the aluminum plates were rinsed with water.

(8) Desmutting

After the etching, the aluminum plates were desmutted by being immersed in an aqueous solution containing 25 wt % of sulfuric acid at 60° C. After the desmutting, the aluminum plates were rinsed with water.

(9) Anodizing

The aluminum plates were anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 2.4 g/m$^2$. After the anodizing, the aluminum plates were sprayed with rinse water.

The thus treated aluminum plates had neither streaks nor grainy unevenness in surface quality that would have otherwise occurred on the surface due to directional differences in crystal grains.

An intermediate layer and a light-sensitive layer were applied to the aluminum plates and dried to produce positive-working PS plates each having a dry film thickness of 2.0 g/m$^2$. The PS plates turned out to be good printing plates on press.

Comparative Example 2

An aluminum plate was roughened as in Example 10 except that neither of the steps (3), (4) and (5) were performed. The thus treated aluminum plate had streaks and grainy unevenness in surface quality developing on the surface due to directional differences in crystal grains.

According to the present invention, an aluminum support for lithographic printing plates that is less prone to the appearance of "streaks" of "grainy unevenness in surface quality" which are defects that would otherwise occur from the difference in the rate of aluminum dissolution due to directional differences in crystal grains can be produced at low cost.

Example 17

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.48 mm. The bristles were closely embedded in the sidewall of a stainless steel cylinder having a diameter of 300 mm. Two support rollers (200 mm$^{\Phi}$) were spaced apart by 300 mm under the brushes. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 10 g/m$^2$. After the etching, the aluminum plate was rinsed with water.

(3) Desmutting

Subsequently, the aluminum plates were desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plates were rinsed with water.

(4) Electrochemical Roughening in Aqueous Solution of Nitric Acid

Electrochemical roughening was performed continuously using an AC voltage of the waveform shown in FIG. 1 and two units of the apparatus shown in FIG. 2. The electrolyte was an aqueous solution of 1 wt % nitric acid (containing 0.5 wt % of aluminum ion and 0.007 wt % of ammonium ion) at 65° C. (Example 17-1), 70° C. (Example 17-2) or 80° C. (Example 17-3). The AC supply voltage had such a waveform that tp (time for the current to increase from zero up to a peak) was 0.3 msec and the duty ratio was 1:1. Using an alternating current of a trapezoidal waveform at 60 Hz, the aluminum plates were roughened electrochemically with a carbon electrode being used as a counter electrode. The auxiliary anode was made of ferrite.

The current density was 50 A/dm$^2$ in terms of a peak current value and the amount of electricity was 120 C/dm$^2$ in terms of the total sum of electricity applied to the aluminum plate working as anode. Five percent of the current from the power supply was shunted to the auxiliary anode. After the electrochemical roughening, the aluminum plates were sprayed with rinse water.

(5) Etching in Aqueous Solution of Alkali

The aluminum plate was etched by being immersed in an aqueous solution containing 26 wt % of NaOH and 6.5 wt % of aluminum ion at 45° C. The aluminum plates dissolved in an amount of 0.3 g/m$^2$. After the etching, the aluminum plates were rinsed with water.

(6) Desmutting

After the electropolishing, the aluminum plates were rinsed with water. Subsequently, they were desmutted by being immersed in an aqueous solution containing 25 wt % of sulfuric acid at 60° C. Thereafter, the aluminum plates were rinsed with water.

(7) Anodizing

The aluminum plates were anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 2.4 g/m$^2$. After the anodizing, the aluminum plates were sprayed with rinse water.

The thus treated aluminum plates had neither streaks nor grainy unevenness in surface quality that would have otherwise occurred on the surface due to directional differences in crystal grains. The plates had an average surface roughness of ca. 0.6 $\mu$m.

An intermediate layer and a light-sensitive layer were applied to the aluminum plates and dried to produce positive-working PS plates each having a dry film thickness of 2.0 g/m$^2$. The PS plates turned out to be good printing plates on press.

Example 18

An aluminum plate was roughened as in Example 1, except that the chemical etching in the aqueous alkali solution in (5) of Example 17-3 was replaced by electropolishing in an aqueous solution containing 9 wt % of sodium hydroxide and 0.5 wt % of aluminum ion at 35° C. and at a current density of 20 A/dm$^2$, with the aluminum plate used as anode, such that 1 g/m$^2$ of aluminum dissolved. An intermediate layer and a negative-working light-sensitive layer were applied to the thus treated aluminum plate and dried to produce a PS plate, which turned out to be a good printing plate on press.

Example 19

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality. The plate was subjected to the following consecutive steps.

(1) Mechanical Roughening

Siliceous sand having a specific gravity of 1.12 was suspended in water to prepare an abrasive liquid slurry. With the slurry being supplied onto the surface of the aluminum plate, the latter was mechanically roughened with three rotating nylon brushes in a roller form. Each brush had bristles that were made of 6.10 nylon and which had a length of 50 mm and a diameter of 0.295 mm. The bristles-were closely embedded in the sidewall of a stainless steel cylinder having a diameter of 300 mm. Two support rollers (200 mm$^{\Phi}$) were spaced apart by 300 mm under the brushes. Each brush roller was pressed against the aluminum plate until the load of a motor driving the brush to rotate was 6 kw in excess of the initial value. The brushes rotated in the same direction as the aluminum plate advanced. After the mechanical roughening, the aluminum plate was rinsed with water. The speed of the advancing plate was 50 m/min.

(2) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 6 g/m$^2$. After the etching, the aluminum plate was rinsed with water.

(3) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(4) Primary Electrochemical Roughening in Aqueous Solution of Hydrochloric Acid

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 40 C/dm$^2$ in terms of the total sum of electricity applied to the aluminum pate working as anode. Five percent of the current from the power supply was shunted to the auxiliary anode. After the electrochemical roughening, the aluminum plate was sprayed with rinse water.

(5) Etching in Aqueous Solution of Alkali

The aluminum plate was etched by being immersed in an aqueous solution containing 26 wt % of NaOH and 6.5 wt % of aluminum ion at 45° C. The aluminum plate dissolved in an amount of 0.3 g/m$^2$. After the etching, the aluminum plate was rinsed with water.

(6) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(7) Electrochemical Roughening in Aqueous Solution of Nitric Acid

Electrochemical roughening was performed continuously using an AC voltage of the waveform shown in FIG. 1 and two units of the apparatus shown in FIG. 2. The electrolytes was an aqueous solution of 1 wt % nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as counter electrode. The auxiliary anode was made of ferrite.

The current density was 50 A/dm$^2$ in terms of a peak current value and the amount of electricity in terms of the total sum of electricity applied to the aluminum plate working as anode was 30 C/dm$^2$ (Example 19-1) or 120 C/dm$^2$ (Example 19-2). Five percent of the current from the power supply was shunted to the auxiliary anode. After the electrochemical roughening, the aluminum plates were sprayed with rinse water.

(8) Etching in Aqueous Solution of Alkali

The aluminum plates were etched by being immersed in an aqueous solution containing 26 wt % of NaOH and 6.5 wt % of aluminum ion at 45° C. The aluminum plates dissolved in an amount of 1 g/m$^2$. After the etching, the aluminum plates were rinsed with water.

(9) Desmutting

After the etching, the aluminum plates were desmutted by being immersed in an aqueous solution containing 25 wt % of sulfuric acid at 60° C. After the desmutting, the aluminum plates were rinsed with water.

(10) Anodizing

The aluminum plates were anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 1.2 g/m$^2$. After the anodizing, the aluminum plates were sprayed with rinse water.

The thus treated aluminum plates had neither streaks nor grainy unevenness in surface quality that would have otherwise occurred on the surface due to directional differences in crystal grains. The plates had an average surface roughness of ca. 0.35 $\mu$m.

An intermediate layer and a light-sensitive layer were applied to the aluminum plates and dried to produce positive-working PS plates each having a dry film thickness of 2.0 g/m$^2$. Using these PS plates, printing was done on a proofing press-and the following good results were obtained: white color, good layout proofing, high ink receptivity, and smooth movement of a sponge on the plate surface which had to be manually handled to replenish dampening water.

Example 20

An aluminum plate was roughened as in Example 19-1, except that the chemical etching in the aqueous alkali solution in (8) of Example 19-1 was replaced by electropolishing in an aqueous solution containing 9 wt % of sodium hydroxide and 0.5 wt % of aluminum ion at 35° C. and at a current density of 20 A/dm$^2$, with the aluminum plate used as anode, such that 2 g/m$^2$ of aluminum dissolved. An intermediate layer and a light-sensitive layer were applied to the thus treated aluminum plate and dried to produce a proofing positive-working PS plate having a dry film thickness of 2.0 g/m$^2$. Using this PS plate, printing was done on a proofing press and the following good results were obtained: white color, good layout proofing, high ink receptivity, and smooth movement of a sponge on the plate surface which had to be manually handled to replenish dampening water.

Example 21

An aluminum plate (JIS A1050) having a thickness of 0.24 mm and a width of 1,030 mm was produced by a direct casting method without the steps of intermediate annealing and soaking and with chemical etching being performed in an aqueous solution of an acid or an alkali. The plate was prone to the appearance of streaks and grainy unevenness in surface quality. The plate was subjected to the following consecutive steps.

(1) Etching in Aqueous Solution of Alkali

The aluminum plate was etched by being immersed in an aqueous solution containing 27 wt % of NaOH and 6.5 wt % of aluminum ion at 70° C. The aluminum plate dissolved in an amount of 3 g/m$^2$. After the etching, the aluminum plate was rinsed with water.

(2) Desmutting

Subsequently, the aluminum plate was desmutted by being immersed in an aqueous solution containing 1 wt % of hydrochloric acid at 35° C. for 10 seconds. After the desmutting, the aluminum plate was rinsed with water.

(3) Electrochemical Roughening in Aqueous Solution of Hydrochloric Acid (to Form Fine Asperities)

Electrochemical roughening was performed continuously using an AC voltage of the waveform shown in FIG. 1 and a single unit of the apparatus shown in FIG. 2. The electrolyte was an aqueous solution of 1 wt % hydrochloric acid (containing 0.5 wt % of aluminum ion) at 35° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 50 C/dm$^2$ in terms of the total sum of electricity applied to the aluminum plate working as anode. Five percent of the current from the power supply was shunted to the auxiliary anode. After the electrochemical roughening, the aluminum plate was sprayed with rinse water.

(4) Etching in Aqueous Solution of Alkali

The aluminum plate was etched by being immersed in an aqueous solution containing 5 wt % of NaOH and 0.5 wt % of aluminum ion at 45° C. The aluminum plate dissolved in an amount of 0.3 g/m$^2$. After the etching, the aluminum plate was rinsed with water.

(5) Desmutting

Subsequently, the aluminum plate was desmutted by being immersed in an aqueous solution of 1 wt % nitric acid (containing 0.5 wt % of aluminum ion and 0.007 wt % of ammonium ion) at 35° C. for 10 seconds. After the desmutting, the aluminum plate was rinsed with water.

(6) Electrochemical Roughening in Aqueous Solution of Nitric Acid

Electrochemical roughening was performed continuously using an AC voltage of the waveform shown in FIG. 1 and two-units of the apparatus shown in FIG. 2. The electrolyte was an aqueous solution of 1 wt % of nitric acid (containing 0.5 wt % of aluminum ion and 0.007 wt % of ammonium ion) at 50° C. The AC supply voltage had such a waveform that tp (time for the current to increase from zero up to a peak) was 1 msec and the duty ratio was 1:1. Using an alternating current of a trapezoidal waveform at 60 Hz, the aluminum plate was roughened electrochemically with a carbon electrode being used as a counter electrode. The auxiliary anode was made of ferrite.

The current density was 50 A/dm$^2$ in terms of a peak current value and the amount of electricity was 100 C/dm$^2$ in terms of the total sum of electricity applied to the aluminum plate working as anode. Five percent of the current from the power supply was shunted to the auxiliary anode. After the electrochemical roughening, the aluminum plates was sprayed with rinse water.

(7) Etching in Aqueous Solution of Alkali

The aluminum plate was etched by being immersed in an aqueous solution containing 27 wt % of NaOH and 6.5 wt % of aluminum ion at 40° C. The aluminum plate dissolved in an amount of 0.05 g/m$^2$. After the etching, the aluminum plate was rinsed with water.

(8) Desmutting

After the etching, the aluminum plate was desmutted by being immersed in an aqueous solution containing 25 wt % of sulfuric acid at 60° C. After the desmutting, the aluminum plate was rinsed with water.

(9) Anodizing

The aluminum plate was anodized in an aqueous solution of 15 wt % sulfuric acid (containing 0.5 wt % of aluminum ion) at 35° C. using a DC voltage at a current density of 2 A/dm$^2$ until an anodic oxide film formed in an amount of 2.4 g/m$^2$. After the anodizing, the aluminum plate was sprayed with rinse water.

The thus treated aluminum plate had neither streaks nor grainy unevenness in surface quality that would have otherwise occurred on the surface due to directional differences in crystal grains.

An intermediate layer and a light-sensitive layer were applied to the aluminum plate and dried to produce a positive-working PS plate having a dry film thickness of 2.0 g/m$^2$. The PS plate turned out to be a good printing plate on press.

Comparative Example 3

An aluminum plate was roughened as in Example 1, except that electrochemical roughening step (4) was conducted in the aqueous solution of nitric acid at 50° C. The thus treated aluminum plate had streaks and grainy unevenness in surface quality appeared on the surface due to directional differences in crystal grains.

According to the present invention, aluminum supports for lithographic printing plates can be manufactured at low cost that are free from the appearance of "streaks" or "grainy unevenness in surface quality" which are defects that would otherwise occur from the difference in the rate of aluminum dissolution due to directional differences in crystal grains; the aluminum supports hence yield satisfactory lithographic printing plates.

What is claimed is:

1. A process for producing an aluminum support for a lithographic printing plate comprising, in sequence, the steps of:

(1) subjecting an aluminum plate to preliminary AC electrochemical roughening in an aqueous solution based on hydrochloric acid using electricity in an amount of 1 to 300 C/dm$^2$;

(2) immersing the aluminum plate in an aqueous solution of an acid or an alkali to perform chemical etching or electropolishing with said aluminum plate being used as anode, so that the aluminum plate is dissolved in an amount of 0.01 to 1.5 g/m$^2$;

(3) subjecting the aluminum plate to DC or AC electrochemical roughening in an aqueous solution based on nitric acid; and (4) immersing the aluminum plate in an aqueous solution of an acid or an alkali to perform chemical etching or electropolishing with said aluminum plate being used as anode, so that the aluminum plate is dissolved in an amount of 0.01 to 10 g/m$^2$.

2. The process for producing an aluminum support for a lithographic printing plate according to claim 1, wherein the amount of dissolution of aluminum by the chemical etching in an aqueous solution of an acid or an alkali which is performed after the DC or AC electrochemical roughening in an aqueous solution based on nitric acid is 0.01 to 1.5 g/m$^2$.

3. The process for producing an aluminum support for a lithographic printing plate according to claim 1, wherein the aluminum plate is desmutted in an acidic aqueous solution after it is chemically etched, or electropolished with the aluminum plate used as anode, in an aqueous solution of an acid or an alkali.

4. The process for producing an aluminum support for a lithographic printing plate according to claim 1, further comprising a subsequent anodizing step.

5. The process for producing an aluminum support for a lithographic printing plate according to claim 4, further comprising a hydrophilizing step following to the anodizing step.

6. A process for producing an aluminum support for a lithographic printing plate comprising, in sequence, the steps of:

(1) mechanically roughening an aluminum plate;

(2) immersing the aluminum plate in an aqueous solution of an acid or an alkali to perform chemical etching, or electropolishing with said aluminum plate being used as anode, so that the aluminum plate is dissolved in an amount of 0.01 to 20 g/m$^2$;

(3) subjecting the aluminum plate to preliminary AC electrochemical roughening in an aqueous solution based on hydrochloric acid using electricity in an amount of 1 to 300 C/dm$^2$;

(4) immersing the aluminum plate in an aqueous solution of an acid or an alkali to perform chemical etching, or electropolishing with said aluminum plate being used as anode, so that the aluminum plate is dissolved in an amount of 0.01 to 1.5 g/m$^2$;

(5) subjecting the aluminum plate to DC or AC electrochemical roughening in an aqueous solution based on nitric acid; and (6) immersing the aluminum plate in an aqueous solution of an acid or an alkali to perform chemical etching, or electropolishing with said aluminum plate being used as anode, so that the aluminum plate is dissolved in an amount of 0.01 to 10 g/m$^2$.

7. The process for producing an aluminum support for a lithographic printing plate according to claim 6, wherein the amount of dissolution of aluminum by the chemical etching in an aqueous solution of an acid or an alkali which is performed after the DC or AC electrochemical roughening in an aqueous solution based on nitric acid is 0.01 to 1.5 g/m$^2$.

8. The process for producing an aluminum support for a lithographic printing plate according to claim 6, wherein the aluminum plate is desmutted in an acidic aqueous solution after it is chemically etched, or electropolished with the aluminum plate used as anode, in an aqueous solution of an acid or an alkali.

9. The process for producing an aluminum support for a lithographic printing plate according to claim 6, further comprising a subsequent anodizing step.

10. A process for producing an aluminum support for a lithographic printing plate comprising, in sequence, the steps of:

(1) subjecting an aluminum plate to preliminary AC electrochemical roughening in an aqueous solution based on hydrochloric acid using electricity in an amount of 1 to 300 C/dm$^2$;

(2) immersing the aluminum plate in an aqueous solution of an acid or an alkali to perform either chemical etching, or electropolishing with said aluminum plate being used as anode, so that the aluminum plate is dissolved in an amount of 0.01 to 1.5 g/m$^2$;

(3) subjecting the aluminum plate to AC electrochemical roughening in an aqueous solution based on nitric acid at a temperature of 60 to 95° C. so as to form honeycomb pits with an average diameter of 0.1 to 0.5 $\mu$m using electricity in an amount of 1 to 150 C/dm$^2$; and (4) immersing the aluminum plate in an aqueous solution of an acid or an alkali to perform chemical etching or electropolishing with said aluminum plate being used as anode, so that the aluminum plate is dissolved in an amount of 0.01 to 10 g/m$^2$.

11. The process for producing an aluminum support for a lithographic printing plate according to claim 10, wherein the amount of dissolution of the aluminum plate by the chemical etching in an aqueous solution of an acid or an alkali which is performed after honeycomb pits with an average diameter of 0.1 to 0.5 $\mu$m are formed using electricity in an amount of 1 to 150 C/dm$^2$ by AC electrochemical roughening in an aqueous solution based on nitric acid at a temperature of 60 to 95° C. is 0.01 to 1.5 g/m$^2$.

12. The process for producing an aluminum support for lithographic printing plates according to claim 10, wherein the aluminum plate is desmutted in an acidic aqueous solution after it is chemically etched, or electropolished with the aluminum plate used as anode, in an aqueous solution of an acid or an alkali.

13. The process for producing an aluminum support for lithographic printing plates according to claim 10, further comprising a subsequent anodizing step.

14. The process for producing an aluminum support for lithographic printing plates according to claim 13, further comprising a hydrophilizing step following the anodizing step.

* * * * *